US006942512B1

(12) United States Patent
Yoon et al.

(10) Patent No.: US 6,942,512 B1
(45) Date of Patent: Sep. 13, 2005

(54) RELEASABLE ELECTRICAL CONNECTOR FOR USE WITH CIRCUIT CARDS

(75) Inventors: Seungyun Yoon, Upper Darby, PA (US); Keith D. Mease, Gibbstown, NJ (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 10/735,409

(22) Filed: Dec. 12, 2003

Related U.S. Application Data

(63) Continuation-in-part of application No. 10/334,560, filed on Dec. 30, 2002, now Pat. No. 6,688,902.

(51) Int. Cl.[7] ..... H01R 11/22
(52) U.S. Cl. ..... 439/267
(58) Field of Search ..... 439/259, 260, 439/266, 267, 637

(56) References Cited

U.S. PATENT DOCUMENTS

| | | | | | |
|---|---|---|---|---|---|
| 3,710,303 | A | * | 1/1973 | Gallager, Jr. | 439/593 |
| 3,990,761 | A | * | 11/1976 | Jayne | 439/267 |
| 4,021,091 | A | | 5/1977 | Anhalt et al. | |
| 4,060,300 | A | * | 11/1977 | Jayne et al. | 439/267 |
| 4,077,688 | A | * | 3/1978 | Cobaugh et al. | 439/267 |
| 4,080,027 | A | | 3/1978 | Benasutti | |
| 4,085,990 | A | * | 4/1978 | Jayne | 439/267 |
| 4,148,537 | A | * | 4/1979 | Sochor | 439/267 |
| 4,179,176 | A | * | 12/1979 | Jayne | 439/267 |
| 4,332,431 | A | * | 6/1982 | Bobb et al. | 439/267 |
| 4,390,224 | A | | 6/1983 | Showman et al. | |
| 4,392,700 | A | | 7/1983 | Showman et al. | |
| 4,428,635 | A | | 1/1984 | Hamsher, Jr. et al. | |
| 4,643,500 | A | * | 2/1987 | Krumme | 439/161 |
| 5,334,038 | A | * | 8/1994 | Davidge et al. | 439/267 |
| 6,283,778 | B1 | | 9/2001 | Kupnicki et al. | |

FOREIGN PATENT DOCUMENTS

| | | | | |
|---|---|---|---|---|
| JP | 54-98986 | * | 8/1979 | 439/267 |
| JP | 1-313864 | | 12/1989 | |
| JP | 2-21584 | | 1/1990 | |

* cited by examiner

*Primary Examiner*—Tho D. Ta
(74) *Attorney, Agent, or Firm*—Lise A. Rode; Mark T. Starr; Law Office of Gary M. Cohen

(57) ABSTRACT

An electrical connector is provided which can releasably engage a circuit card within a slot defined by the electrical connector. A camming mechanism is provided which includes a cover having a series of follower surfaces for cooperating with a corresponding series of camming surfaces and recesses associated with a pin holder. Longitudinal movement of the cover causes the cooperating surfaces to spread open card edge receiving portions of the slot, or to close down over the portions of the circuit card to be engaged. The electrical connector preferably has an opening in one end to allow a circuit card to enter the slot from the side, allowing circuit cards to be removed from or installed in a rack, frame or other chassis from the side.

41 Claims, 6 Drawing Sheets

RELEASABLE ELECTRICAL CONNECTOR FOR USE WITH CIRCUIT CARDS

CROSS-REFERENCE TO RELATED APPLICATION

This patent application is a continuation-in-part of prior U.S. patent application Ser. No. 10/334,560, filed Dec. 30, 2002, which has since issued as U.S. Pat. No. 6,688,902, on Feb. 10, 2004, and which is commonly owned.

BACKGROUND OF THE INVENTION

The present invention generally relates to electrical connectors, and more particularly, to electrical connectors for mating circuit cards and the like with frames, racks and other chassis for receiving such circuit cards.

Any of a variety of systems have been developed for receiving a series of circuit boards (i.e., circuit cards) in a frame, rack or other chassis. To this end, the frame, rack or receiving chassis is provided with a series of electrical connectors capable of mating with corresponding structures provided on the circuit cards. The resulting connections then operate to supply each circuit card with power for its operation, and to permit the exchange of data and any necessary operating signals.

In practice, it is generally necessary to combine a relatively large numbers of circuit cards in a single system to achieve a desired result. Over time, the need will arise to service the circuit cards, for example, to replace a circuit card which has become defective, to make an exchange with a circuit card having modified or upgraded capabilities, or to add a circuit card to or delete a circuit card from the overall system.

During such servicing procedures, it was traditionally necessary to remove power from, or "power down" the circuit cards to be serviced (removed or replaced) to protect the electrical systems associated with the circuit cards being serviced and/or other circuit cards associated with the system. This would often require a large number of circuit cards to be powered down to perform a desired servicing operation. This could, in turn, lead to a significant loss of function (system downtime) during the servicing procedure.

To minimize such losses of function during a desired servicing operation, so-called "hot plug" systems were developed. Such systems allow individual circuit cards to be addressed, and powered up and down from a central control unit. This then allows the individual circuit cards to be removed, replaced and/or added to the system without first having to take the system, or substantial portions of the system, off-line (i.e., powered down). As a result, portions of the system other than those requiring service can continue to operate during the servicing procedure, in this way minimizing losses of overall system function during such servicing. For this reason, hot plug technology has become an industry standard solution for providing users with increased system availability (reduced system downtime) and enhanced serviceability in various computing environments.

In operation, hot plug technology allows a single circuit card, for example, a PCI adapter card, to be isolated from the remainder of the system by isolating the PCI slot which is to receive the PCI card from other devices associated with the system. Isolation of the PCI slot includes the powering down of the (single) PCI slot, allowing the removal and/or insertion of a PCI card, and protection of the remaining elements of the system from potentially adverse electrical effects of the PCI card exchanges being made. The result is that the identified PCI card can be removed and/or inserted without interrupting the ongoing operations being performed by the remainder of the system.

Although such operations permit individual circuit cards to be removed and replaced while minimizing losses of function (system downtime) during the servicing procedure, it remains necessary to physically remove and insert the circuit cards during such servicing. Depending on the configuration of the frame, rack or chassis which receives the circuit cards, this can lead to some practical disadvantages.

For example, a common high availability solution for minimizing system downtime in industry-standard servers uses hot plug technology in conjunction with a mounting rack for receiving plural PCI adapter cards. Slots for receiving the PCI adapter cards are defined by electrical connectors which are physically connected to the rack, and which include a series of pins extending along opposing sides of the slot defined by the electrical connector for establishing electrical connections with a corresponding series of pads provided on the surfaces of the PCI adapter cards (i.e., along the "card edge"). The edge of the PCI adapter card having the series of pads can then be frictionally engaged within the slot of one of the electrical connectors, and between the series of pins, establishing necessary electrical connections with the electrical connector and the remainder of the system, and retaining the PCI adapter card in desired position.

To remove a PCI adapter card, the card is grasped (by hand or using a tool) and pulled from the electrical connector. To install a PCI adapter card, the edge of the PCI adapter card having the series of pads is aligning with the slot defined by the electrical connector, and the aligned card edge is inserted into the slot so that the pads on the card edge are engaged by the pins of the electrical connector.

Depending upon the orientation of the PCI adapter card and the electrical connector (horizontal, vertical, etc.), and the structural elements comprising the rack, access to the PCI adapter card can at times be limited. Consequently, while hot plug technology can operate to temporarily deactivate a PCI slot which is to be accessed, the amount of time and difficulty in physically accessing the PCI adapter card remains limited by the relative inconvenience of accessing a particular slot.

To help minimize this inconvenience, the PCI adapter cards and the slots (connectors) which are to receive them are often grouped together in a so-called "module box" which is removably mated with the rack. The module box can then be pulled from the rack to expose the PCI adapter cards it contains for servicing. In conjunction with hot plug technology, the PCI adapter cards associated with the module box are isolated, for servicing, while the remainder of the system remains powered.

While this facilitates access to the PCI adapter card which is to be serviced, this then leads to a corresponding disadvantage that the remaining PCI adapter cards associated with the module box are also deactivated when the module box is removed from the rack, giving rise to a potential loss of function. Consequently, the need remains for an electrical connector which can receive circuit cards in a manner which permits individual circuit cards to be accessed for service, independently of other circuit cards associated with the system and without interrupting operations of the other circuit cards associated with the system.

Irrespective of the configuration of the rack (frame or chassis) which is used to receive the PCI adapter cards, the frictional engagement which is maintained between the card edge and the electrical connector will, over time, tend to cause these components to wear as a result of repeated servicing operations. Consequently, the need remains for an electrical connector which can receive circuit cards in a manner which reduces the amount of friction developed between the engaged card edge and the electrical connector, to increase the overall durability and service life of both the card edge and the electrical connector.

SUMMARY OF THE INVENTION

These and other disadvantages are overcome by providing an electrical connector which can releasably engage a circuit card within a slot defined by the electrical connector. As is conventional, frictional engagement is developed between the circuit card and the electrical connector to establish desired electrical connections between the circuit card and the electrical connector, and to retain the circuit card in desired position. In accordance with the present invention, the electrical connector includes a release mechanism for removing the frictional engagement developed between the circuit card and the electrical connector, in this way allowing the circuit card to be freely removed from the slot of the electrical connector, or installed in the slot of the electrical connector, as desired. The release mechanism is preferably implemented using a camming mechanism which is mated with the slot of the electrical connector.

In an embodiment of the present invention which is disclosed in U.S. patent application Ser. No. 10/334,560, filed Dec. 30, 2002, which has since issued as U.S. Pat. No. 6,688,902, on Feb. 10, 2004, the camming mechanism includes a slide having a series of camming surfaces which can cooperate with a corresponding series of follower surfaces associated with a pin holder. Longitudinal movement of the slide causes the cooperating camming and follower surfaces to spread open card edge receiving portions of the slot of the electrical connector. This then allows the appropriate portions of the circuit card (i.e., the card edge and pads of a PCI adapter card) to enter the slot substantially free of frictional engagement with the slot and the pins of the electrical connector. The slide is then returned to its initial position to cause the spread open portions of the electrical connector to close down over the portions of the circuit card which are to be engaged, establishing desired electrical connections and frictionally engaging the circuit card within the slot of the electrical connector.

In an alternative embodiment of the present invention, the camming mechanism includes a cover having a series of follower surfaces which can cooperate with a corresponding series of camming surfaces and recesses associated with a pin holder. Longitudinal movement of the cover causes the cooperating camming and follower surfaces to spread open card edge receiving portions of the slot of the electrical connector. This then allows the appropriate portions of the circuit card (i.e., the card edge and pads of a PCI adapter card) to enter the slot substantially free of frictional engagement with the slot and the pins of the electrical connector. The cover is then returned to its initial position to cause the spread open portions of the electrical connector to close down over the portions of the circuit card which are to be engaged, establishing desired electrical connections and frictionally engaging the circuit card within the slot of the electrical connector.

The electrical connector of the present invention is preferably provided with an opening in an end of the connector body to allow a circuit card to enter the slot defined by the electrical connector from the side. An end of the cover is also provided with an opening, in general alignment with the opening in the end of the connector body. The release mechanism can then be used to spread open the card edge receiving portions of the slot of the electrical connector, allowing the circuit card to move freely, and allowing a circuit card to be withdrawn from the slot or introduced into the slot from the side of the electrical connector.

A plurality of the electrical connectors of the present invention can advantageously be mated with a conventional frame, rack or other chassis to allow circuit cards to be removed from and installed in the electrical connectors from the side. The openings in the end of the connector body and in the end of the cover allow a circuit card to be removed or installed from the side, through an opening provided in the rack, frame or chassis which houses the circuit card. This allows the circuit cards housed in the rack, frame or chassis (e.g., in a PCI module box associated with a rack) to be replaced independently of other circuit cards, if desired, while the system comprised of the remaining circuit cards is operational (i.e., a hot plug system).

To facilitate the alignment of circuit cards, such as PCI adapter cards, within the slots of the receiving electrical connectors, conventional practice is to provide the edges of the PCI adapter cards which are to be installed with recesses which are positioned to mate with corresponding structures associated with the slot of the electrical connector. The release mechanism of the present invention is fully compatible with such card-aligning structures to ensure that the circuit card is correctly aligned in the slot as the circuit card is removed from, and installed in the slot of the electrical connector.

For further detail regarding preferred embodiments of the present invention, reference is made to the detailed description which is provided below, taken in conjunction with the following illustrations.

DETAILED DESCRIPTION OF THE INVENTION

Figure 1:
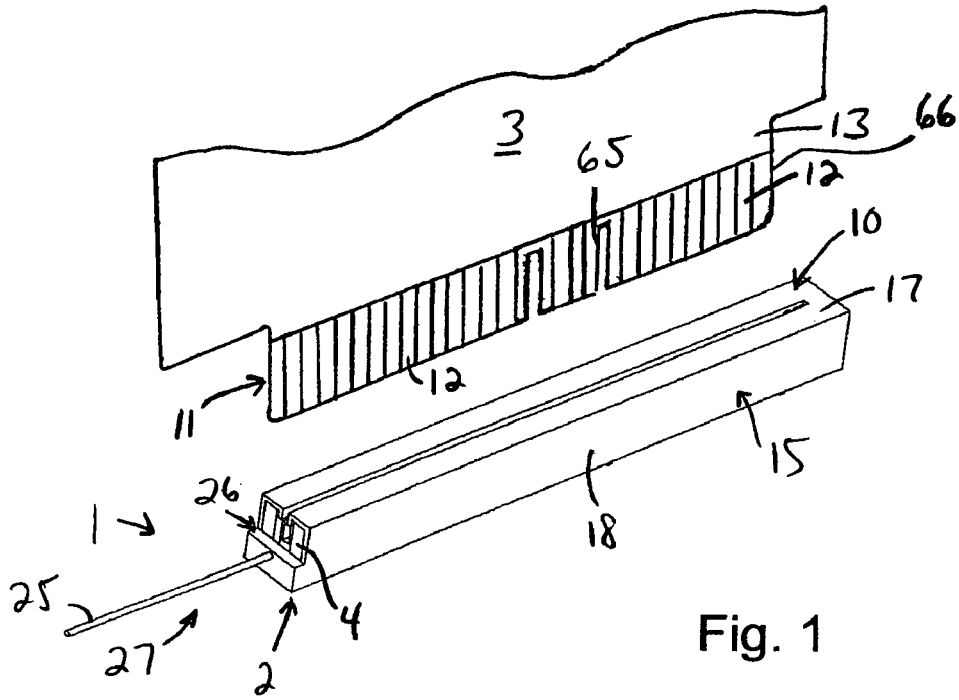
FIG. 1 is an isometric view of a preferred embodiment of the electrical connector of the present invention, together with a typical circuit card aligned to mate with the electrical connector.

FIG. 1 shows a preferred embodiment of an electrical connector 1 having a release mechanism 2 for releasably engaging a circuit card 3. The circuit card 3 selected for illustration in the drawings is a PCI adapter card, which is itself conventional and well known in the industry, and the electrical connector 1 has been configured to mate with this illustrative PCI adapter card. It is to be understood that a PCI adapter card has been selected for illustrative purposes only and that the electrical connector of the present invention can be modified to cooperate with other types of circuit cards, as desired.

Figure 2:
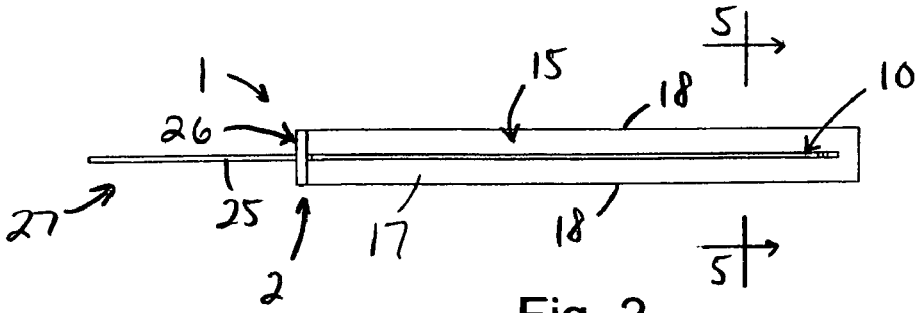
FIG. 2 is a top plan view of the electrical connector shown in FIG. 1.
Figure 3:
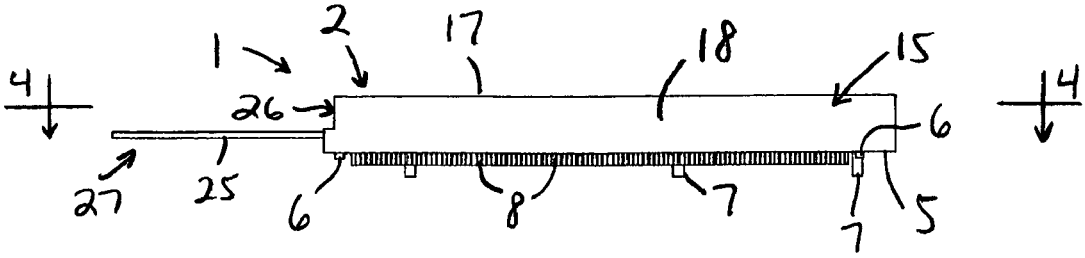
FIG. 3 is a side elevational view of the electrical connector shown in FIG. 1.

Referring to FIGS. 1 to 3, the electrical connector 1 is generally comprised of a connector body 4 having an overall size, shape and configuration suitable for being mated with a desired circuit, rack, frame or other circuit receiving chassis. To this end, the base 5 of the connector body 4 is provided with projecting structures for mounting the electrical connector 1 to the rack, frame or chassis with which it is to be associated, and for establishing desired electrical connections with electrical circuitry associated with the rack, frame or chassis. This can include, but is not limited to, desired structural supports (legs 6 and guides 7) and electrical attachments (pins 8), as shown in the figures, or other desired structures for interacting with the circuit, rack, frame or chassis which is to receive the electrical connector 1, as desired.

The connector body 4 further defines a slot 10 for receiving the circuit card 3. As is conventional, the slot 10 extends longitudinally along the center of the connector body 4, and has a width which substantially corresponds to the thickness of the circuit card 3 so that an edge 11 of the circuit card 3 can slidingly enter the slot 10. The pins 8 which project from the base 5 of the connector body 4 extend upwardly, through the connector body 4, and are aligned within the connector body 4 to establish electrical connections with the circuit card 3. To this end, the edge 11 of the circuit card 3 is provided with a series of pads 12, which are formed of an electrically conducting material and which are generally provided on opposing sides 13 of the card edge 11, to establish desired electrical connections between the pads 12 and the pins 8 as the card edge 11 enters the slot 10.

Conventional practice is to provide the slot 10 with a width, and to provide the opposing series of pins 8 (see FIG. 4) with a separation (within the body 4) which will slidingly and frictionally engage the card edge 11, and the pads 12 associated with the card edge 11, within the slot 10 and between the opposing series of pins 8. The frictional engagement developed between the circuit card 3 and the electrical connector 1 establishes the desired electrical connections between the circuit card 3 and the electrical connector 1, and retains the circuit card 3 in desired position. To remove the circuit card 3 from the electrical connector 1, the circuit card 3 is grasped (by hand or using a tool) and pulled from the electrical connector 1, overcoming the frictional engagement present between the pins 8 and the pads 12. To install a circuit card 3, the edge 11 of the circuit card 3 is aligning with the slot 10, and the aligned card edge 11 is inserted into the slot 10 so that the pads 12 are frictionally engaged by the pins 8 of the electrical connector 1.

In accordance with the present invention, the release mechanism 2 operates to separate, or spread open the opposing series of pins 8, to substantially eliminate the frictional forces developed between the pads 12 of the circuit card 3 and the pins 8 of the electrical connector 1. This then allows the circuit card 3 to be freely removed from the slot 10 of the electrical connector 3, or installed in the slot 10 of the electrical connector 3, as desired.

Figure 4:
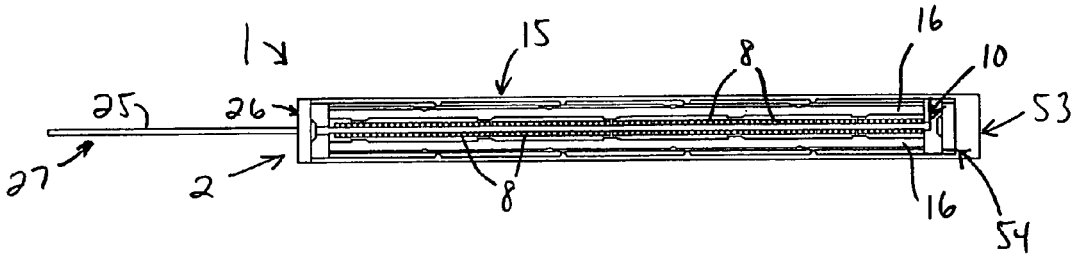
FIG. 4 is a cross-sectional view of the electrical connector shown in FIG. 1, viewed along the line 4—4 shown in FIG. 3.
Figure 5:
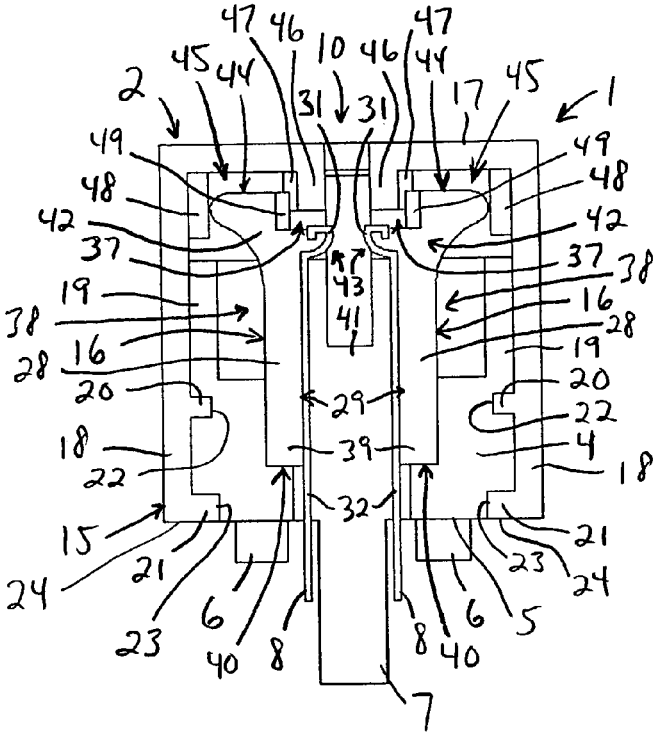
FIG. 5 is a cross-sectional view of the electrical connector shown in FIG. 1, viewed along the line 5—5 shown in FIG. 2.

Referring now to FIGS. 4 and 5, the release mechanism 2 generally includes a cover 15 coupled with a pair of pin holders 16. The cover 15 and the pin holders 16 each extend longitudinally along the connector body 4.

As is best shown in FIG. 5, the cover 15 includes a face 17 and opposing sides 18 which overlie and surround the connector body 4. The opposing sides 18 of the cover 15 are in sliding engagement with opposing sides 19 of the connector body 4. Paired flanges 20, 21 extend from the opposing sides 18 of the cover 15, and are positioned to engage a corresponding pair of grooves 22, 23 formed in the opposing sides 19 of the connector body 4. The flanges 21 extending from the bottom edges 24 of the sides 18 of the cover 15 preferably cooperate with the corresponding grooves 23 formed in the opposing sides 19 of the connector body 4 to complete the overall outer configuration for the electrical connector 1. A rod 25 projects from an end 26 of the cover 15, forming a handle 27 which can be grasped to advance and retract the cover 15 relative to the connector body 4 as will be discussed more fully below.

Figure 6:
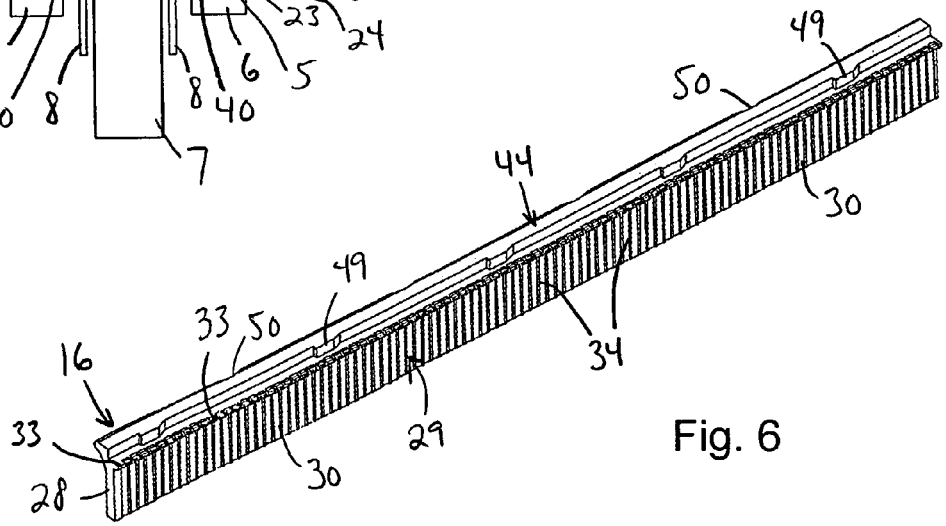
FIG. 6 is an isometric view of one of the pin holders associated with the electrical connector, showing the pin receiving grooves.
Figure 7:
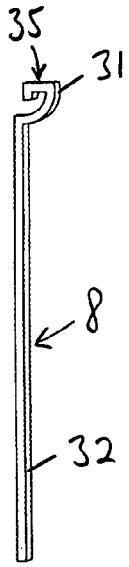
FIG. 7 is an isometric view of one of the pins associated with the pin holder.
Figure 8:
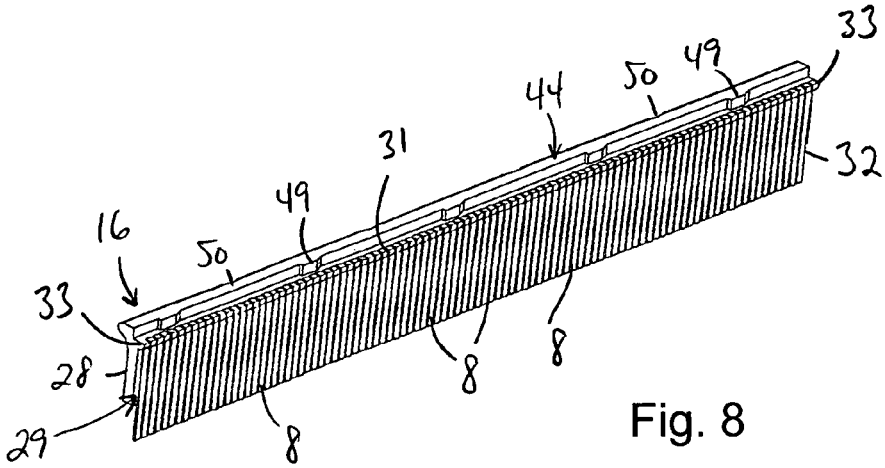
FIG. 8 is an isometric view of one of the pin holders associated with the electrical connector, showing the pins mated with the grooves.

Referring now to FIG. 6, each of the pin holders 16 generally takes the form of an inverted, dog-leg-shaped structure, and includes a web 28 for receiving a series of the pins 8. To this end, the outer face 29 of the web 28 is provided with a series of grooves 30, each sized to receive one of the pins 8. FIG. 7 shows one of the pins 8, having a curved contact portion 31 for establishing an electrical connection with one of the pads 12 of the circuit card 3, and an electrically conductive body 32 for projecting from the base 5 of the connector body 4 as previously described. The contact portion 31 mates with a correspondingly configured projection 33 associated with each of the grooves 30 formed in the outer face 29 of the web 28. The grooves 30 are separated by a series of ribs 34, defining the individual grooves 30 for receiving the pins 8 (both the contact portion 31 and the body 32). FIG. 8 shows a series of pins 8 mated with the grooves 30 in the outer face 29 of one of the pin holders 16. As is best shown in FIGS. 5 and 8, the curved portions 31 of the pins 8 have flat portions 35, and the projections 33 associated with the grooves 30 formed in the outer face 29 of the web 28 have flat portions 36, which combine to provide an open channel 37 for receiving cooperating structures of the cover 15, as will be discussed more fully below.

The connector body 4 includes a pair of cavities 38 for receiving the pin holders 16, and the pair of pin holders 16 are formed as mirror images of each other, substituting for the fixed surfaces which were previously used to receive the opposing series of pins associated with a conventional electrical connector. Base portions 39 of the web 28 of each of the pin holders 16 are received within a cavity 40 formed in the connector body 4. The cavity 40 operates to securely retain each pin holder 16 within the connector body 4, and against a center support 41 which includes the slot 10 for receiving the card edge 11, either frictionally or using an adhesive. To be noted is that this leaves an opposing end 42 of each web 28 free for transverse movement relative to the slot 10, within the cavities 38.

As a result, the contact portions 31 of the pins 8 are then aligned with and are configured to pass through a window 43 which communicates with the slot 10. Interaction between camming and follower portions associated with the cover 15 and upper portions 44 of the pin holders 16 can then operate to either urge the contact portions 31 of the pins 8 into the slot 10, or to draw the upper portions 44 of the pin holders 16 into the cavities 38 of the connector body 4, withdrawing the contact portions 31 of the pins 8 from the slot 10.

Urging the contact portions 31 of the pins 8 into the slot 10 operates to securely engage the edge 11 and the pads 12 of the circuit card 3, establishing desired electrical connections and securely retaining the circuit card 3 within the slot 10. Withdrawal of the contact portions 31 of the pins 8 from the slot 10 operates to spread open and separate the series of pins 8 associated with the opposing pin holders 16, to free the edge 11 of the circuit card 3 either for removal from, or insertion into the slot 10. This then allows the card edge 11 to slidingly enter or exit the slot 10, without frictional interference with the pins 8 of the electrical connector 1.

Figure 9:
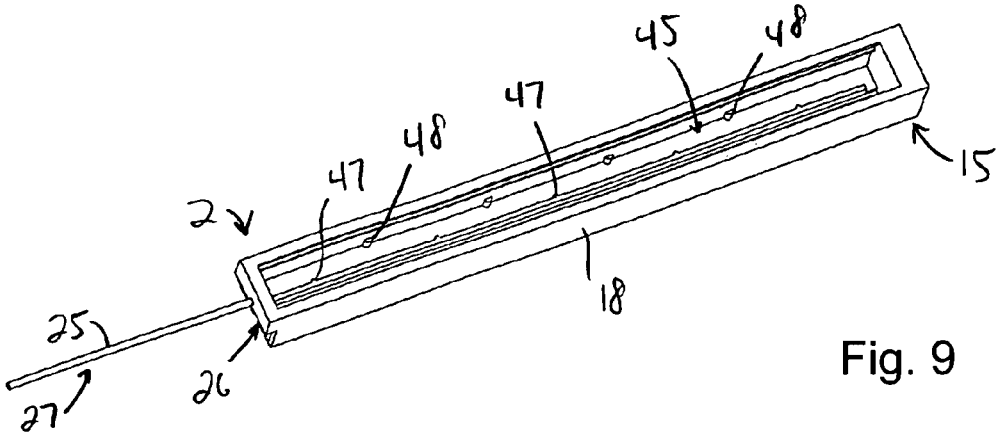
FIG. 9 is an isometric view of the cover of the electrical connector shown in FIG. 1, viewed from the bottom of the cover.

Preferred structures for developing the interaction between the cover 15 and the pin holders 16 which is used to spread the series of pins 8, for insertion of the card edge 11, and to close the series of pins 8 down over the inserted card edge 11, are shown with reference to FIGS. 5, 6 and 9.

FIG. 9 shows interior portions of the cover 15 in greater detail. A pair of cavities 45 are formed in the cover 15, for cooperating with the upper portions 44 of each of the pin holders 16, extending between the sides 18 of the cover 15 and portions 46 of the cover 15 which form the slot 10 for receiving the card edge 11. A series of projections 47, 48 are formed on opposing sides of the cavities 45, which are preferably placed at spaced locations along the sides 18 and the slot-forming portions 46 of the cover 15. Referring now to FIGS. 5 and 6, the upper portions 44 of each of the pin holders 16 further include a series of projections 49 and recesses 50, which are positioned on opposing sides of the pin holders 16 and which are preferably placed at spaced locations along the pin holders 16 for cooperating with the projections 47, 48 of the cover 15.

Figure 10:
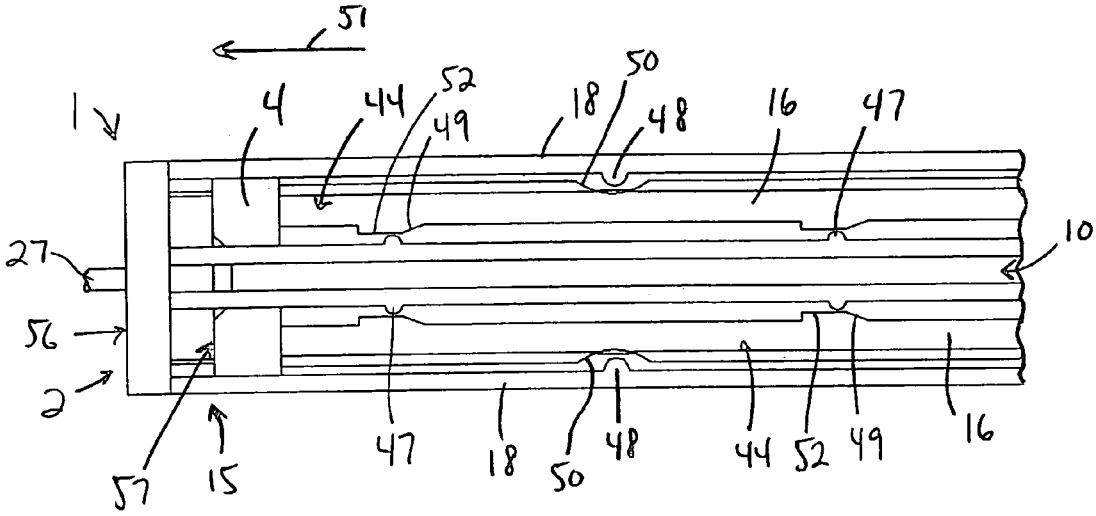
FIG. 10 is an enlarged, partial cross-sectional view of the electrical connector, similar to FIG. 4, and showing full retraction of the cover.

Referring now to FIG. 10, assume that the removal of a circuit card, or the installation of a circuit card, is to be performed. To "open" the slot 10 of the electrical connector 1, the handle 27 of the cover 15 is grasped and pulled outwardly from the connector body 4. This will cause retraction of the cover 15, advancing the projections 47, 48 toward the end 51 of the connector body 4.

The projections 47 of the cover 15 are preferably formed as semi-circular surfaces, and the projections 49 of the pin holders 16 are preferably formed as inclined surfaces, providing opposing camming and follower surfaces for interaction with each other. Retraction of the cover 15 will draw the outwardly facing projections 47 on the cover 15 into engagement with the inwardly facing projections 49 provided on each of the pin holders 16. This will, in turn, operate to draw the upper portions 44 of the pin holders 16 outwardly, drawing the contact portions 31 of the pins 8 out of the slot 10, as previously described. Retraction of the cover 15 will also bring the projections 48 of the cover 15 into alignment with the recesses 50 of the pin holders 16, enabling desired outward movement of the pin holders 16.

The projections 49 are preferably provided with flat portions 52 to establish stable regions for maintaining interaction between the projections 49 and the opposing projections 47. Interaction between the rear 53 of the cover 15 and the rear 54 of the connector body 4 preferably serves as a stop capable of indicating when the cover 15 has been fully retracted and that the projections 47, 48 on the cover 15 have been aligned with the projections 49 and the recesses 50 on the pin holders 16.

A circuit card can then be freely removed from or inserted into the slot 10, without encountering the pins 8, and as result, without encountering any significant friction or insertion forces.

Figure 11:
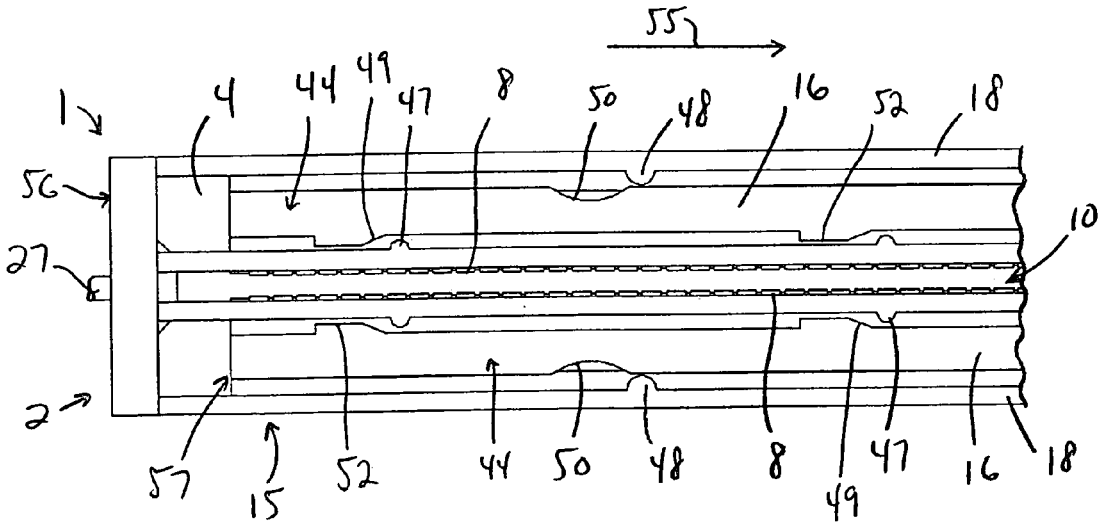
FIG. 11 is an enlarged, partial cross-sectional view of the electrical connector, similar to FIG. 4, and showing full advancement of the cover.

Following the insertion of a circuit card into the slot 10 of the electrical connector 1, and referring now to FIG. 11, the handle 27 of the cover 15 is again grasped and pushed into the connector body 4 to "close" the slot 10 over the inserted circuit card. This will cause the cover 15 to advance the projections 47, 48 toward the end 55 of the connector body 4.

Such advancement of the cover 15 will operate to draw the outwardly facing projections 47 on the cover 15 out of engagement with the inwardly facing projections 49 provided on each of the pin holders 16, and to draw the inwardly facing projections 48 on the cover 15 out of the recesses 50 provided on each of the pin holders 16. This will, in turn, operate to draw the upper portions 44 of the pin holders 16 inwardly, drawing the contact portions 31 of the pins 8 into the slot 10 and into engagement with the pads on the circuit card as previously described. This will also operate to secure the circuit card in the slot 10. The resiliency of the webs 28 operates to draw the contact portions 31 into engagement with the pads on the circuit card, acting as a return spring for the pin holders 16. Interaction between the front 56 of the cover 15 and the front 57 of the connector body 4 preferably serves as a stop capable of indicating when the cover 15 has been fully advanced into the connector body 4 and that the pin holders 16 have been fully released for return to a closed position.

The electrical connector 1 can be used in any of a variety of applications, to effectively interact with any of a variety of circuit cards. One or more of the electrical connectors 1 can be mated with any of a variety of frames, racks or other chassis, to provide any of a variety of circuit forming configurations. One such application to which the electrical connector 1 is particularly well suited is hot plug technology, where it is desirable to access and to replace circuit cards associated with a system independently of other circuit cards and while the overall system remains active and operational.

Figure 12:
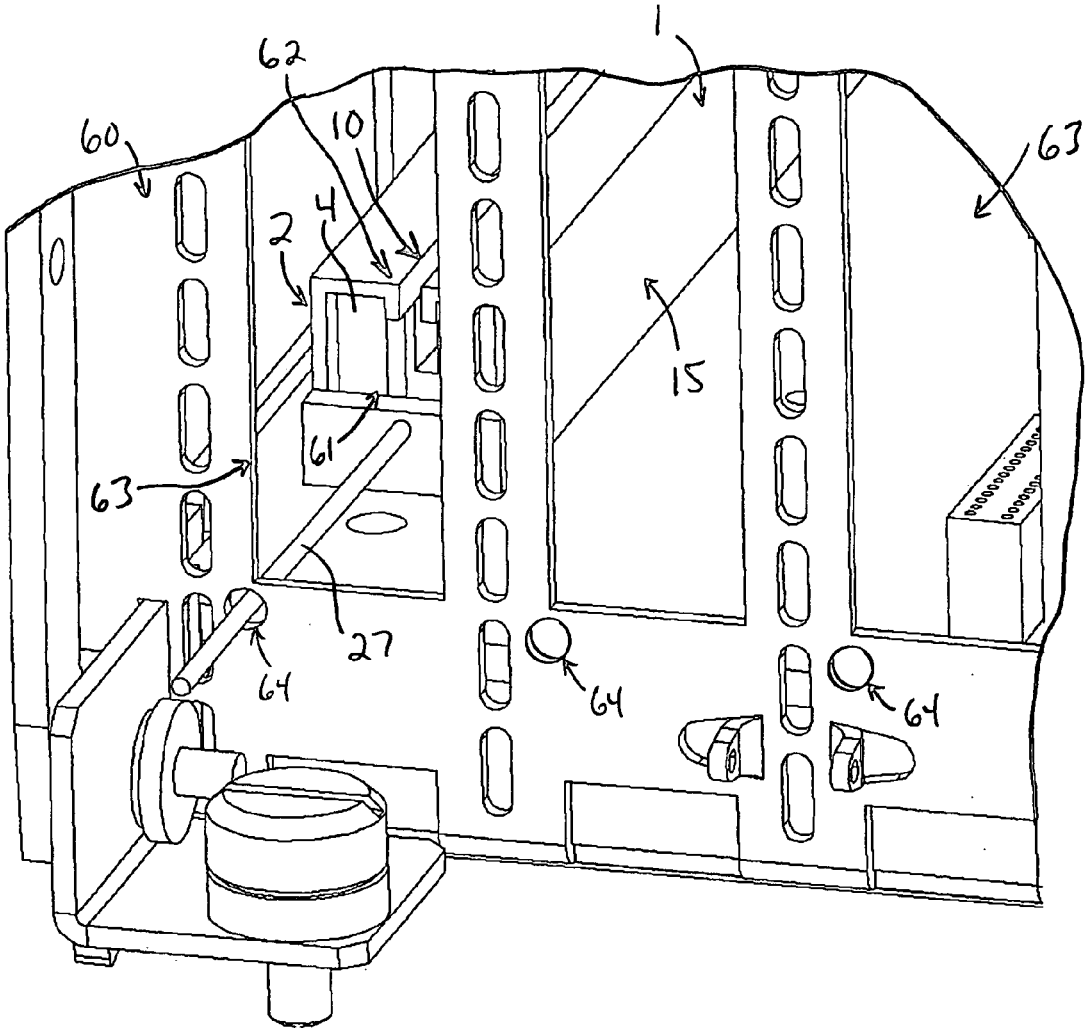
FIG. 12 is an isometric view showing a module box incorporating the electrical connector of the present invention, viewed from the front of the module box.
Figure 13:
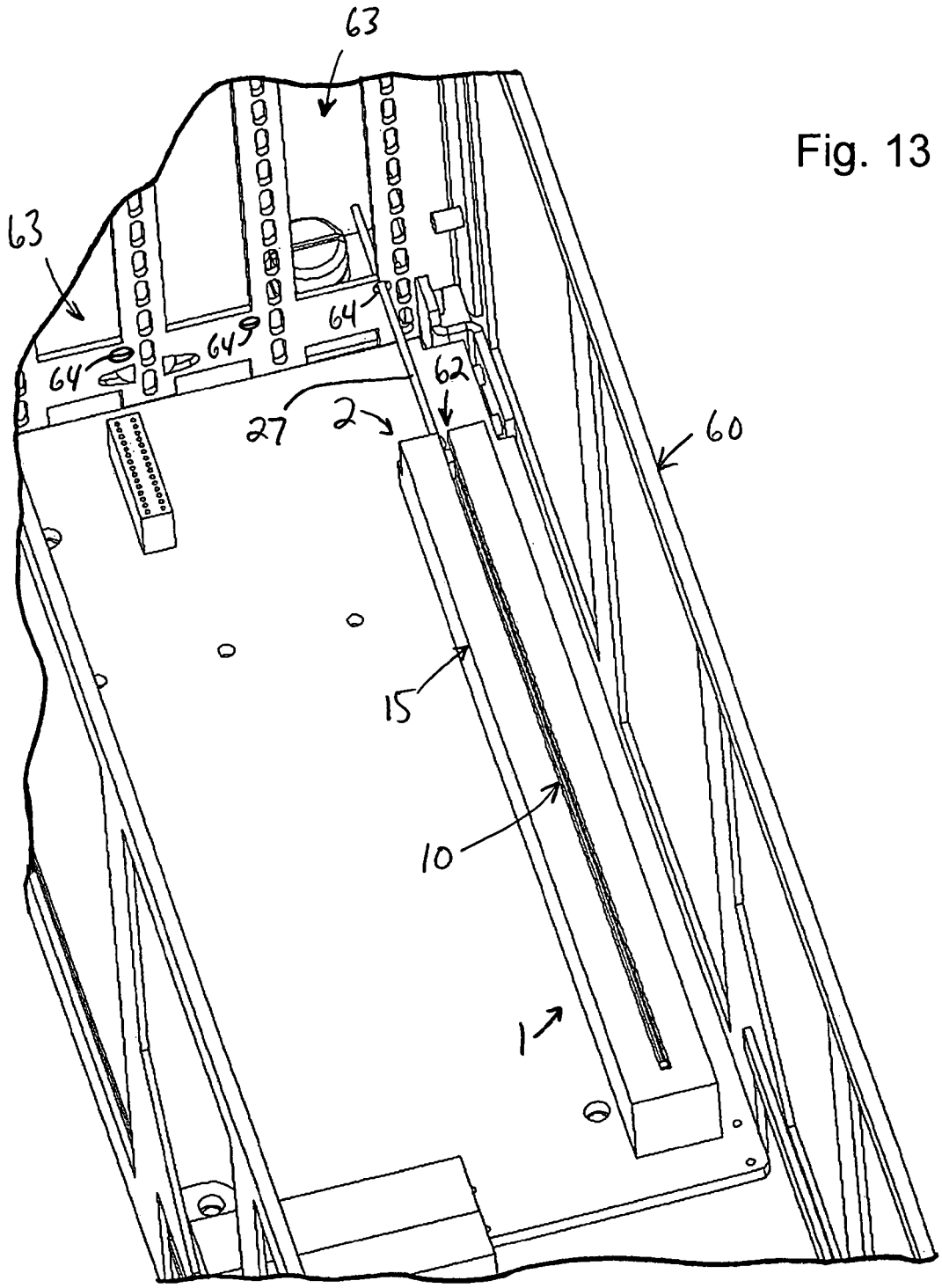
FIG. 13 is an isometric view showing the module box of FIG. 12 from the top.

Referring now to FIGS. 12 and 13, portions of a typical rack configuration which is adapted for use with hot plug technology are shown. In particular, one of what will typically comprise a large number of module boxes is shown, removed from the overall rack (not shown) which receives the module boxes. Conventional practice is for the circuit card to be serviced (removed and/or inserted) to be identified and isolated from the remainder of the system. The module box, which is removably mated with the rack, is then pulled from the rack to expose the identified circuit card for servicing (i.e., removal and/or insertion through the top of the withdrawn module box). Because the withdrawn module box typically holds other circuit cards, the remaining circuit cards associated with the module box will then also be deactivated, resulting from the removal of the module box from the rack.

In accordance with the present invention, each of a plurality of circuit cards can be individually accessed, independently of any other circuit cards associated with the module box 60, using the electrical connector 1 previously described. Only one electrical connector 1 is shown mated with the module box 60, for simplification of the drawings. Remaining spaces, for receiving other circuit cards, would preferably be similarly fitted with an electrical connector 1.

To avoid the need to have to access circuit cards associated with the module box 60 from the top, each of the electrical connectors 1 is preferably provided with an opening 61 in the front 57 of the connector body 4, and an opening 62 in the front 56 of the cover 15 which is in general alignment with the opening 61 in the front 57 of the connector body 4. The openings 61, 62 are sized to slidingly receive the edge 11 of a circuit card 3 (see FIG. 1), allowing the circuit card to laterally enter the slot 10. This, in turn, allows the circuit card to be withdrawn from, or introduced into the slot 10 from the side of the module box 60, rather than from the top. To this end, the module box 60 is preferably provided with side openings 63, for receiving the circuit cards, and openings 64 for receiving the handle 27 of the cover 15 of the electrical connector 1.

In use, a circuit card to be withdrawn from the electrical connector 1 associated with the module box 60 is first isolated from the remainder of the system, by the hot plug technology, as is conventional. The module box 60 housing the isolated electrical connector 1 need not be removed from the rack, and other circuit cards (not shown) associated with the module box 60 can remain active.

To remove a circuit card from the isolated electrical connector 1, the handle 27 of the cover 15 extending through the opening 64 is grasped and pulled out. This then draws the contact portions 31 of the pins 8 associated with the electrical connector 1 from the slot 10, freeing any circuit card then located in the slot 10. The circuit card then in the slot 10 is grasped and drawn from the slot 10. To this end, the card edge 11 will freely pass through the openings 61, 62 and the circuit card will freely pass through the opening 63. The handle 27 adjacent to the openings 61, 62 is spaced from the openings 61, 62 to allow the card edge 11 to freely pass between the electrical connector 1 and the opening 63.

To install a circuit card in the electrical connector 1, the circuit card is passed through the opening 63 so that the card edge 11 is in alignment with the openings 61, 62. The card edge 11 is then inserted through the openings 61, 62, entering the slot 10 from the side. After the card edge 11 has been fully inserted into the slot, the handle 27 of the cover 15 is pushed toward the electrical connector 1, moving the contact portions 31 of the series of pins 8 into engagement with the installed circuit card. This then operates to secure the circuit card within the electrical connector 1, and to establish desired electrical connections with the pads 12 on the card edge 11. The electrical connector 1 can then be activated by the hot plug technology, placing the installed circuit card in service.

To facilitate the alignment of card edges relative to the slots of conventional electrical connectors, circuit cards such as PCI adapter cards are traditionally provided with recesses 65 (see FIG. 1) which are positioned to mate with corresponding structures associated with the slot of the electrical connector. To facilitate the removal of circuit cards from, and the installation of circuit cards into the slot 10 of the electrical connector 1 of the present invention, particularly in cases where the circuit card is to be removed or installed from the side, the slot 10 must be clear of structures for mating with the recesses 65. The release mechanism of the present invention is fully compatible with such card-aligning structures to ensure that the circuit card is correctly aligned in the slot 10 as the circuit card is removed from, and installed in the slot 10 of the electrical connector 1. To this end, contact between the rear 66 of the card edge 11 and the rear 54 of the connector body 4 will operate to effectively locate a circuit card in the slot 10 which is to receive it.

It will, therefore, be understood that various changes in the details, materials and arrangement of parts which have been herein described and illustrated in order to explain the nature of this invention may be made by those skilled in the art within the principle and scope of the invention as expressed in the claims which follow. For example, the disclosed electrical connector 1 has an opposing pair of pin holders 16 positioned on opposite sides of the slot 10. It is also possible to employ only a single pin holder, if desired. Any opposing pins could then be mounted on fixed portions of the connector body, leaving the single pin holder to engage and disengage circuit cards as previously described. Other alternative embodiments will occur to the person of ordinary skill.

What is claimed is:

1. An electrical connector for receiving a circuit card having a card edge including a plurality of electrical contacts, the electrical connector comprising:

a body having portions for connecting the electrical connector to external circuit elements, a slot formed in the body for receiving the card edge, wherein the slot has a size which substantially corresponds to the card edge, and a plurality of pins associated with the slot and extending through the body, wherein the pins are positioned for engagement with the electrical contacts of the circuit card; and a release mechanism enclosing portions of the body of the electrical connector and the pins associated with the slot, for urging the pins into the slot when the release mechanism assumes a first operating position, and for drawing the pins out of the slot when the release mechanism assumes a second operating position;

wherein the release mechanism includes;

a cover extending longitudinally along the body, and extending along the slot, wherein the cover is movable between the first operating position and the second operating position; and a pin holder including a web having face portions for receiving the plurality of pins, wherein the pin holder is coupled with the cover and with the body for transverse movement relative to the slot, and wherein the plurality of pins are attached to the pin holder;

wherein the cover has a cavity for receiving upper portions of the web, and a plurality of projections extending into the cavity of the cover, and wherein the upper portions of the pin holder include a plurality of projections on a first side facing the face portions of the pin holder and a plurality of recesses on a second side opposite to the first side.

2. The electrical connector of claim 1 wherein the release mechanism includes a pair of pin holders positioned on opposite sides of the slot, wherein the plurality of pins are attached to the pair of pin holders, and wherein each of the pin holders is coupled with the cover.

3. The electrical connector of claim 1 wherein the web has base portions for engaging a cavity formed in the body.

4. The electrical connector of claim 1 wherein the pins have electrical contacts associated with the upper portions the web, and wherein the electrical contacts are positioned adjacent to the slot.

5. The electrical connector of claim 1 wherein the cover includes a handle extending from the cover.

6. The electrical connector of claim 1 wherein first projections extending into the cavity of the cover and the projections of the upper portions of the pin holder form cooperating camming and follower surfaces.

7. The electrical connector of claim 6 wherein second projections extending into the cavity of the cover cooperate with the recesses of the upper portions of the pin holder.

8. The electrical connector of claim 6 wherein the cooperating camming and follower surfaces include inclined surfaces for cooperating with opposing, curved surfaces.

9. The electrical connector of claim 8 wherein the inclined surfaces include flat portions forming a surface for stable engagement with the opposing, curved surfaces.

10. The electrical connector of claim 1 wherein first projections extending into the cavity of the cover on the first side of the upper portions of the pin holder are aligned with the projections of the upper portions of the pin holder when the release mechanism is in the second operating position, and wherein the first projections of the cover are offset from the projections of the upper portions of the pin holder when the release mechanism is in the first operating position.

11. The electrical connector of claim 10 wherein second projections extending into the cavity of the cover on the second side of the upper portions of the pin holder are aligned with the recesses of the upper portions of the pin holder when the release mechanism is in the second operating position, and wherein the second projections of the cover are offset from the recesses of the upper portions of the pin holder when the release mechanism is in the first operating position.

12. The electrical connector of claim 1 wherein the slot extends longitudinally between opposing ends of the body, wherein the electrical connector further includes an opening formed in an end of the body and an opening formed in an end of the cover, and wherein the opening in the body and the opening in the cover have a size which substantially corresponds to the card edge, for slidingly receiving the circuit card in the slot through the openings.

13. The electrical connector of claim 12 wherein the opening formed in the end of the body is in substantial alignment with the opening formed in the end of the cover.

14. The electrical connector of claim 12 wherein the release mechanism includes a handle extending from the cover, and wherein the handle is adjacent to the openings and spaced from the openings to allow the card edge to pass the handle.

15. The electrical connector of claim 12 wherein the card edge has a rear edge for engaging one of the opposing ends of the body, for locating the card edge in the slot.

16. An electrical connector for receiving a circuit card having a card edge including a plurality of electrical contacts, the electrical connector comprising:

a body having portions for connecting the electrical connector to external circuit elements, a slot formed in the body for receiving the card edge, wherein the slot has a size which substantially corresponds to the card edge, and a plurality of pins associated with the slot and extending through the body, wherein the pins are positioned for engagement with the electrical contacts of the circuit card;

a cover coupled with the body and extending longitudinally along the body and the slot, wherein the cover is movable between a first operating position and a second operating position; and a pin holder including a web having face portions for receiving the plurality of pins and coupled with the cover and with the body, for transverse movement relative to the body and the slot responsive to movement of the cover between the first operating position and the second operating positions;

wherein the cover has a cavity for receiving upper portions of the web, wherein the cover includes a plurality of projections extending into the cavity of the cover, and wherein the upper portions of the pin holder include a plurality of projections on a first side facing the face portions of the pin holder and a plurality of recesses on a second side opposite to the first side.

17. The electrical connector of claim 16 wherein the pin holder is moved toward the slot when the cover is in the first operating position, and wherein the pin holder is moved away from the slot when the cover is in the second operating position.

18. The electrical connector of claim 16 which includes a pair of pin holders positioned on opposite sides of the slot, wherein the plurality of pins are attached to the pair of pin holders, and wherein each of the pin holders is coupled with the cover.

19. The electrical connector of claim 16 wherein the web has base portions for engaging a cavity formed in the body.

20. The electrical connector of claim 16 wherein the pins have electrical contacts associated with the upper portions the web, and wherein the electrical contacts are positioned adjacent to the slot.

21. The electrical connector of claim 16 wherein the cover includes a handle extending from the cover.

22. The electrical connector of claim 16 wherein first projections extending into the cavity of the cover and the projections of the upper portions of the pin holder form cooperating camming and follower surfaces.

23. The electrical connector of claim 22 wherein second projections extending into the cavity of the cover cooperate with the recesses of the upper portions of the pin holder.

24. The electrical connector of claim 22 wherein the cooperating camming and follower surfaces include inclined surfaces for cooperating with opposing, curved surfaces.

25. The electrical connector of claim 24 wherein the inclined surfaces include flat portions forming a surface for stable engagement with the opposing, curved surfaces.

26. The electrical connector of claim 16 wherein first projections extending into the cavity of the cover on the first side of the upper portions of the pin holder are aligned with the projections of the upper portions of the pin holder when the cover is in the second operating position, and wherein the first projections of the cover are offset from the projections of the upper portions of the pin holder when the cover is in the first operating position.

27. The electrical connector of claim 26 wherein second projections extending into the cavity of the cover on the second side of the upper portions of the pin holder are aligned with the recesses of the upper portions of the pin holder when the cover is in the second operating position, and wherein the second projections of the cover are offset from the recesses of the upper portions of the pin holder when the cover is in the first operating position.

28. The electrical connector of claim 16 wherein the slot extends longitudinally between opposing ends of the body, wherein the electrical connector further includes an opening formed in an end of the body and an opening formed in an end of the cover, and wherein the opening in the body and the opening in the cover have a size which substantially corresponds to the card edge, for slidingly receiving the circuit card in the slot through the openings.

29. The electrical connector of claim 28 wherein the opening formed in the end of the body is in substantial alignment with the opening formed in the end of the cover.

30. The electrical connector of claim 28 wherein the cover includes a handle extending from the cover, and wherein the handle is adjacent to the openings and spaced from the openings to allow the card edge to pass the handle.

31. The electrical connector of claim 28 wherein the card edge has a rear edge for engaging one of the opposing ends of the body, for locating the card edge in the slot.

32. A module box incorporating an electrical connector for receiving a circuit card having a card edge including a plurality of electrical contacts, wherein the electrical connector comprises:

a body having portions connecting the electrical connector to the module box, a slot formed in the body for receiving the card edge, wherein the slot has a size which substantially corresponds to the card edge, and a plurality of pins associated with the slot and extending through the body, wherein the pins are positioned for engagement with the electrical contacts of the circuit card;

a cover coupled with the body and extending longitudinally along the body and the slot, wherein the cover is movable between a first operating position and a second operating position; and a pin holder including a web having face portions for receiving the plurality of pins and coupled with the cover and with the body, for transverse movement relative to the body and the slot responsive to movement of the cover between the first operating position and the second operating position;

wherein the cover has a cavity for receiving upper portions of the web, wherein the cover includes a plurality of projections extending into the cavity of the cover, and wherein the upper portions of the pin holder include a plurality of projections on a first side facing the face portions of the pin holder and a plurality of recesses on a second side opposite to the first side.

33. The module box of claim 32 wherein the pin holder is moved toward the slot when the cover is in the first operating position, and wherein the pin holder is moved away from the slot when the cover is in the second operating position.

34. The module box of claim 32 wherein the electrical connector includes a pair of pin holders positioned on opposite sides of the slot, wherein the plurality of pins are attached to the pair of pin holders, and wherein each of the pin holders is coupled with the cover.

35. The module box of claim 32 wherein the cover includes a handle extending from the cover.

36. The module box of claim 32 which further includes plural electrical connectors, for receiving plural circuit cards.

37. The module box of claim 32 wherein the slot extends longitudinally between opposing ends of the body, wherein the electrical connector further includes an opening formed in an end of the body and an opening formed in an end of the cover, and wherein the opening in the body and the opening in the cover have a size which substantially corresponds to the card edge, for slidingly receiving the circuit card in the slot through the openings.

38. The module box of claim 37 wherein the opening formed in the end of the body is in substantial alignment with the opening formed in the end of the cover.

39. The module box of claim 37 wherein the electrical connector is free of structures for interfering with movement of the circuit card within the slot when the cover is in the second operating position.

40. The electrical connector of claim 37 wherein the cover includes a handle extending from the cover, and wherein the handle is adjacent to the openings and spaced from the openings to allow the card edge to pass the handle.

41. The electrical connector of claim 37 wherein the card edge has a rear edge for engaging one of the opposing ends of the body, for locating the card edge in the slot.

* * * * *